US009167870B2

(12) United States Patent
Poulakis

(10) Patent No.: US 9,167,870 B2
(45) Date of Patent: Oct. 27, 2015

(54) TOUCH-AND-CLOSE FASTENER PART AND METHOD FOR PRODUCING A TOUCH-AND-CLOSE FASTENER PART

(75) Inventor: Konstantinos Poulakis, Hildrizhausen (DE)

(73) Assignee: Gottlieb Binder GmbH & Co. KG., Holzgerlingen (DE)

( * ) Notice: Subject to any disclaimer, the term of this patent is extended or adjusted under 35 U.S.C. 154(b) by 1017 days.

(21) Appl. No.: 13/137,091

(22) Filed: Jul. 20, 2011

(65) Prior Publication Data

US 2012/0017404 A1 Jan. 26, 2012

(30) Foreign Application Priority Data

Jul. 20, 2010 (DE) ..... 10 2010 027 616

(51) Int. Cl.

| | |
|---|---|
| ***D04B 1/22*** | (2006.01) |
| ***A44B 18/00*** | (2006.01) |
| ***D04B 1/04*** | (2006.01) |

(52) U.S. Cl.

CPC ..... *A44B 18/0023* (2013.01); *D04B 1/04* (2013.01); *D04B 1/22* (2013.01); *D10B 2501/0632* (2013.01); *Y10T 24/2783* (2015.01); *Y10T 24/2792* (2015.01); *Y10T 29/49826* (2015.01)

(58) Field of Classification Search

CPC ..... D04B 1/02; D04B 1/04; D04B 7/12; D04B 9/12; D04B 11/08; D04B 21/02; D04B 21/04; A44B 18/0023; A44B 18/0042

USPC ..... 66/169 R, 170, 190, 191, 194; 24/445, 24/442; 428/99, 100

See application file for complete search history.

(56) References Cited

U.S. PATENT DOCUMENTS

| | | | | | |
|---|---|---|---|---|---|
| 3,539,436 | A | * | 11/1970 | Hamano | 428/100 |
| 3,616,501 | A | * | 11/1971 | Waller | 26/9 |
| 3,654,054 | A | * | 4/1972 | Waller | 428/89 |
| 3,845,640 | A | * | 11/1974 | Waller | 66/91 |
| 3,845,641 | A | * | 11/1974 | Waller | 66/192 |
| 3,895,489 | A | * | 7/1975 | Waller | 66/91 |
| 4,338,800 | A | * | 7/1982 | Matsuda | 66/194 |
| 4,628,709 | A | * | 12/1986 | Aeschbach et al. | 66/9 R |
| 4,705,710 | A | * | 11/1987 | Matsuda | 428/92 |
| 4,709,562 | A | * | 12/1987 | Matsuda | 66/193 |
| 4,838,044 | A | * | 6/1989 | Matsuda et al. | 66/190 |
| 5,692,949 | A | * | 12/1997 | Sheffield et al. | 451/538 |
| 6,096,667 | A | * | 8/2000 | Rhode | 442/313 |

(Continued)

FOREIGN PATENT DOCUMENTS

| | | |
|---|---|---|
| DE | 1 800 030 | 4/1970 |
| DE | 195 15 945 | 11/1996 |

(Continued)

*Primary Examiner* — Danny Worrell

(74) *Attorney, Agent, or Firm* — Roylance, Abrams, Berdo & Goodman LLP

(57) ABSTRACT

A touch-and-close fastener part (32) includes a functional layer forming a backing surface and formed from a thread system with at least two line elements (12*a*-12*d*, 14*a*-14*c*) forming meshes (16*a*-16*b*", 20*a*-20*a*") and connected to one another. At least one further individual functional layer, formed and/or formable with connecting elements (30, 30"), is formed from a further thread system incorporated at least in individual sections into the thread system. The thread systems are connected to one another with the formation of passage sites (24*a*-24*d*) whose free cross-sectional area takes up more than 20% of the corresponding backing area.

15 Claims, 8 Drawing Sheets

(56) References Cited

U.S. PATENT DOCUMENTS

| | | | | |
|---|---|---|---|---|
| 7,231,789 | B2 * | 6/2007 | Chou | 66/191 |
| 8,468,853 | B2 * | 6/2013 | Shepley et al. | 66/85 R |
| 8,656,564 | B2 * | 2/2014 | Chou | 24/442 |

FOREIGN PATENT DOCUMENTS

| | | |
|---|---|---|
| DE | 199 08 874 | 9/1999 |
| DE | 696 18 660 | 8/2002 |
| GB | 2 326 191 | 12/1998 |

* cited by examiner

TOUCH-AND-CLOSE FASTENER PART AND METHOD FOR PRODUCING A TOUCH-AND-CLOSE FASTENER PART

FIELD OF THE INVENTION

The invention relates to a touch-and-close fastener part comprising a functional layer that fixes a backing surface formed from a thread system with at least two line elements forming meshes and that are connected to one another. At least one individual further functional layer having formed and/or formable connecting elements is formed from a thread system incorporated at least in individual sections into the thread system.

BACKGROUND OF THE INVENTION

Touch-and-close fastener parts of this type are used in a wide variety of areas, especially in fastening systems, for example, on articles of clothing, luggage, pieces of furniture, linings in vehicle interiors, etc., and are accordingly known in very widely varying designs. Typically, the touch-and-close fastener part is a textile surface touch-and-close fastener with mushroom-shaped interlocking elements and is generally made of a plastic material. On a back that faces away from the connecting elements, the touch-and-close fastener part can have a coating, for example, an adhesive layer.

Another application of a touch-and-close fastener part is the connection or fastening of an abrasive wheel to an abrasive holder. EP 0 781 629 B1 discloses an abrasive wheel including a layer having an abrasive that is impermeable to particle flow and that can be fastened directly or indirectly via an adapter to an abrasive holder in a work environment. Openings penetrate at least the layer having the abrasive. A hook and loop fastener adaptation layer is designed to be permeable to gas and particles. The openings are made as perforations through which gas and particles can flow and are distributed almost uniformly over the entire surface of the abrasive wheel or a part of it. The individual openings forming the perforation are connected to one another, with their distance to one another being chosen such that almost unimpeded continuous removal of the grinding dust is enabled.

An adapter used in this connection has a hook and loop fastener adaptation layer, a foam particle layer, and a velour layer. The hook and loop fastener adaptation layer faces toward the grinding wheel and is penetrated by the perforations. A typically round grinding wheel has a velour on its back for adhering to the grinding plate. The corresponding arrangement of the opening of the perforations relative to one another and relative to the extractor of the grinding disk causes almost unimpeded transport of the grinding dust to the extractor.

SUMMARY OF THE INVENTION

An object of the invention is to provide a touch-and-close fastener part having a simple structure that, in particular, can be easily produced and can be used to fasten a grinding wheel to an abrasive holder without impeding the grinding process.

This object is basically achieved according to the invention by a touch-and-close fastener part with thread systems connected to one another with the formation of passage sites whose free cross-sectional area takes up more than 20% of the corresponding backing area, on the contact or fastening surface. The grinding dust suctioned off from the grinding wheel for the most part passes unhindered through the touch-and-close fastener part. The touch-and-close fastener part according to the invention in particular offers the advantage that, when a grinding wheel is fastened to the abrasive holder, no special alignment of the touch-and-close fastener part relative to the grinding wheel or the abrasive holder need be chosen since the touch-and-close fastener part is made permeable to dust over its entire surface, more precisely in the region of the further functional layer.

The use of the touch-and-close fastener part according to the invention is not limited to the field of grinding wheels, but extends to any field in which fluid passage on a fastening surface is desired and/or essential. For example, fastening of a screen used for waste water cleanup or exhaust air cleaning in an area through which fluid flows or a filter element used in a hydraulic system is conceivable. Use in the area of breathable textiles in the medical or healthcare field is also conceivable.

In one preferred embodiment of the touch-and-close fastener part according to the invention, at least one thread system that forms a functional layer comprises a series arrangement of at least two line elements adjacent to one another and extending in a longitudinal direction. The line elements each form a sequence of essentially identical meshes that face in a transverse direction and that are arranged without offset to one another in the longitudinal direction. One or more meshes of at least one line element extend through or around the corresponding meshes of the respectively adjacent line element to connect them to one another. This arrangement offers the advantage of a touch-and-close fastener part that is simple to produce and that is of stable shape, and especially a stable, loadable backing surface. The meshes of the individual line elements can be made meandering and can each have a rectangular contour. Alternatively, the meshes can be made loop-like and can have an elliptical or circular contour.

In another preferred embodiment of the touch-and-close fastener part according to the invention, the thread system forming the further functional layer comprises at least one line element extending in the longitudinal direction with a sequence of essentially identical meshes facing in the transverse direction and being separable and/or separated at least partially for the formation of connecting elements. Especially preferably, the at least one line element of the further functional layer extends along a corresponding line element in the backing surface and is accordingly connected to (one) adjacent line element(s). In this way, the further thread system forming the further functional layer, typically a connecting layer, can be easily incorporated into the thread system that forms the backing layer. A correspondingly configured production method can be easily implemented, especially with a weaving or knitting device suitable for formation of the thread system.

Advantageously, the meshes of adjacent line elements in the longitudinal direction have the same extension and/or sequence. In this way, an especially secure and stable bond between the line elements is formed. More preferably, the thread system forming the backing surface has a series arrangement of alternating first and second line elements, with the first meshes of the first line elements in the transverse direction having a greater extension than the second meshes of the second line elements. In this configuration of the touch-and-close fastener part, comparatively fixed connecting sites are created at the crossing points between the meshes of adjacent line elements. As a result, the mesh arrangement is for the most part fixed in position.

In one preferred configuration, the touch-and-close fastener part according to the invention has a pattern that repeats at regular intervals in the transverse and/or the longitudinal direction, with essentially identically designed and/or arranged line elements of the thread systems. This arrangement offers the advantage of a structure that is uniform over the functional layers and backing surface and consequently provides the advantage of uniform properties of the touch-and-close fastener part, such as dimensional stability, elasticity, and fluid permeability.

Advantageously, the functional layer over the entire backing surface is connected to the further thread system, in other words, the touch-and-close fastener part is designed over the entire surface in the manner according to the invention. An elastic or flexible configuration of the touch-and-close fastener part allows it to be attached as a decorative textile fabric on 3D contours, which contours are sometimes complicated, for the purpose of covering them. The touch-and-close fastener part according to the invention is an especially soft, stretchable, open-pored surface structure. The passage openings cleared by the touch-and-close fastener part can be made in the manner of a parallelogram, especially diamond-shaped or rectangular, and/or polygonal, especially hexagonal. In this way, a stable functional layer bond can be ensured with sufficient dimensional stability and fluid permeability of the touch-and-close fastener part.

Advantageously, the touch-and-close fastener part according to the invention is formed of a preferably thermoplastic material, especially polyamide, and preferably isotactic polypropylene. The plastic material is especially preferably recyclable. Isotactic polypropylene is especially well suited for forming interlocking elements with mushroom heads. The line elements of the thread systems are typically made as monofilaments, multifilaments, and/or yarns. They can be dyed according to a desired application.

The connecting elements of the touch-and-close fastener part according to the invention are typically made mushroom-shaped and have interlocking heads. In a furthermore advantageous form, the connecting elements are on one side of the touch-and-close fastener part. A back of the touch-and-close fastener part free of connecting elements is available as a connecting surface to a component such as an abrasive holder. More preferably, an adhesive surface is applied there. Also, one further functional layer With connecting elements on both sides, i.e., on the top and bottom of the touch-and-close fastener part, can be provided.

The invention furthermore encompasses a method for producing a touch-and-close fastener part. Advantageous versions of the method are disclosed hereinafter.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings that form a part of this disclosure and that are schematic and not to scale.

DETAILED DESCRIPTION OF THE INVENTION

Figure 1:
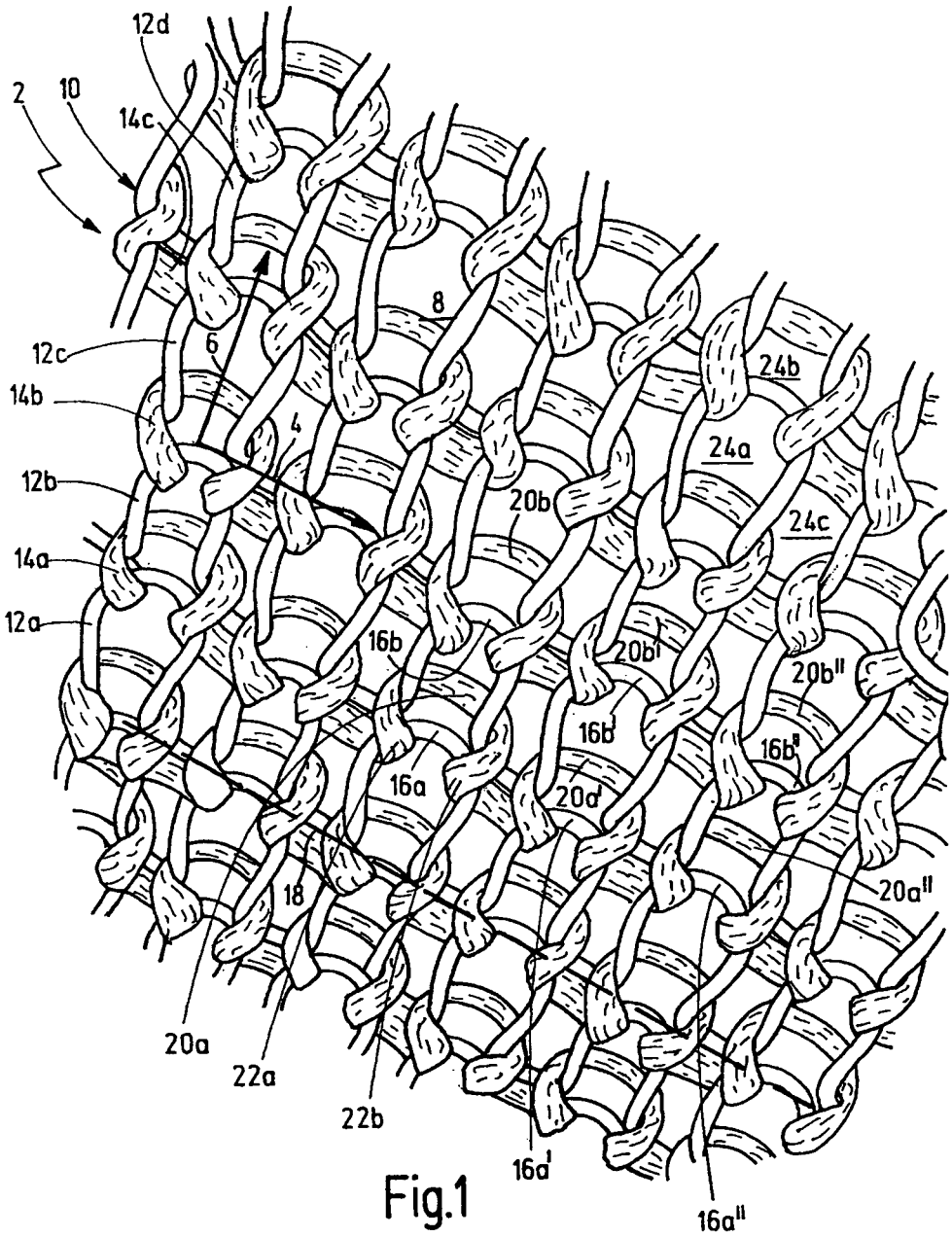
FIG. 1 is a perspective view of a functional layer of a touch-and-close fastener part according to a first exemplary embodiment of the invention, which layer forms a backing surface.

FIG. 1 shows a functional layer 2 that forms a backing surface 8 extending in a longitudinal direction 4 and a transverse direction 6. In the plane of the backing surface 8, a thread system 10 comprises first line elements 12*a*, 12*b*, 12*c*, 12*d* and second line elements 14*a*, 14*b*, 14*c*. The first and second line elements 12*a* to 12*d*, 14*a* to 14*c* are essentially arranged to extend parallel to one another in the longitudinal direction 4 (sequence 12*a*, 14*a*, 12*b*, 14*b*, 12*c*, 14*c*, 12*d*). The first line elements 12*a* to 12*d* are arranged in the thread system 10 such that they each form one sequence of first meshes 16*a*, 16*a*', 16*a*" of the first line element 12*a*, and one sequence of first meshes 16*b*, 16*b*', 16*b*" of the first line element 12*b*, etc. The first meshes 16*a*, 16*a*', 16*a*" are made essentially identical, and each extend in the transverse direction 6. As is indicated by a line 18 for the first line element 12*a*, the first meshes 16*a* to 16*a*" extend from the line 18 in the transverse direction 6 and back again to the line 18, with a rectangular contour being established or a rectangular path being in part traversed by the respective first mesh 16*a* to 16*a*". The first line elements 12*a* to 12*d* are arranged without offset in the longitudinal direction 4 so that in the transverse direction 6, the first mesh 16*b* of the adjacent first line element 12*b* adjoins the first mesh 16*a* of the first line element 12*a*.

The second line elements 14*a* to 14*c* each have a sequence of second meshes 20*a*, 20*a*', 20*a*" of the second line element 14*a*, second meshes 20*b*, 20*b*', 20*b*" of the second line element 14*b*, etc. The second meshes 20*a* to 20*b*" are each made identical and, since the second line elements 14*a* to 14*c* are arranged without offset to one another in the longitudinal direction 4, in the transverse direction 6, they are arranged in direct succession to one another. The connection or interweaving of the first and second line elements 12*a* to 12*d*, 14*a* to 14*c* is explained using the example of the second mesh 20*a*: The second mesh 20*a* extends through the first mesh 16*a* of the first line element 12*a* and is routed around the first mesh 16*b* of the adjacent line element 12*b*. In other words, the first mesh 16*b* is routed through the second mesh 20*a* of the second line element 14*a*. The first mesh 20*a* at two connecting sites 22*a*, 22*b* bonds the adjacent first line elements 12*a*, 12*b* to one another, which are stabilized in their respective locations. To form correspondingly strong connecting sites 22*a*, 22*b*, the extension of the second mesh 20*a* in the transverse direction 6 is shorter than the corresponding extension of the first meshes 16*a* and 16*b*.

The first line elements 12*a* to 12*d* are each formed from a monofilament, while the second line elements 14*a* to 14*d* are each formed from a multifilament. The thread thickness and the mesh width of the first and second line elements 12*a* to 12*d*, 14*a* to 14*c* are chosen such that free passage sites 24*a*, 24*b*, 24*c* are created between the first and second line elements 12*a* to 12*d*, 14*a* to 14*c*, as a result of which the thread system 10 or the functional layer 2 is permeable to fluid. The free passage or cross-sectional areas of the passage sites 24*a* to 24*c* constitute or occupy far more than 20% of the backing surface 8.

Figure 2:
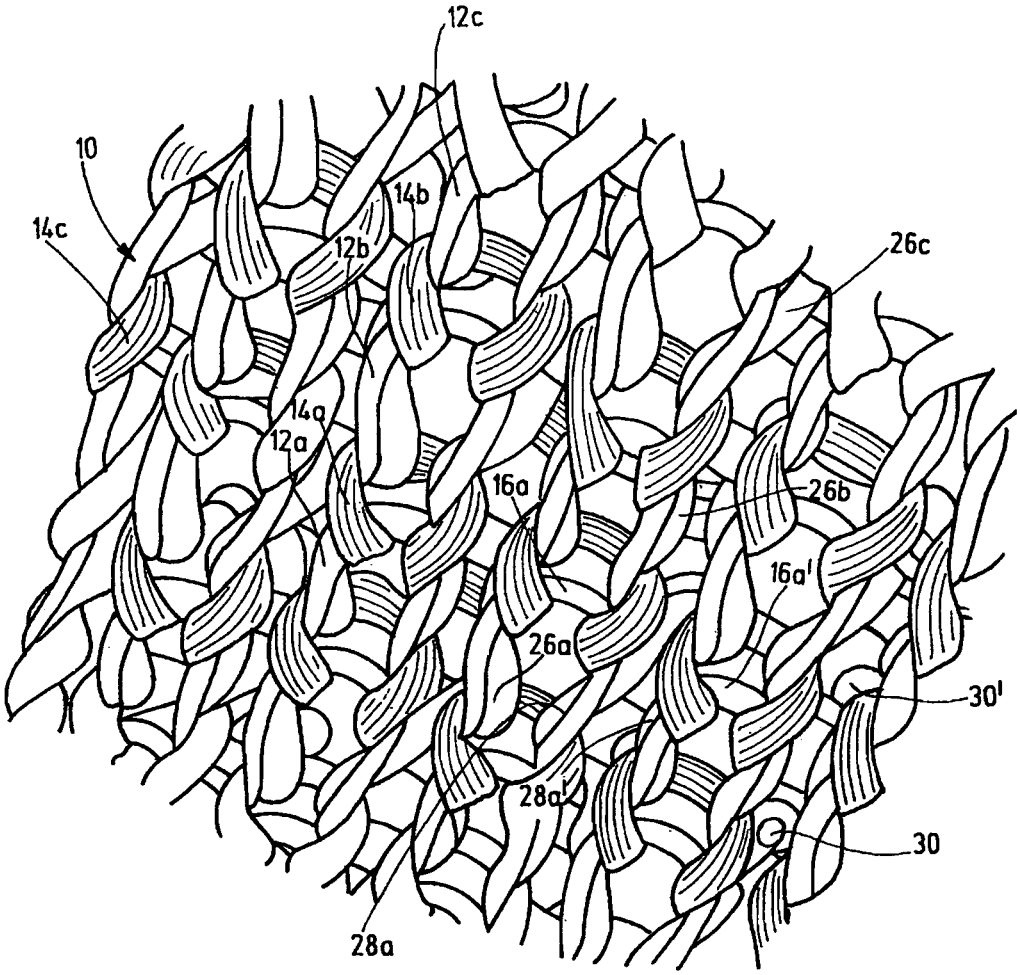
FIG. 2 is a perspective view of the functional layer of FIG. 1, with a further functional layer incorporated into it.

FIG. 2 shows how a further thread system of three line elements 26*a*, 26*b*, 26*c* is incorporated or woven into the thread system 10 of FIG. 1. The third line elements 26*a* to 26*c* each follow the path of a first line element 12*a*, 12*b*, 12*c* and are connected to one another via second line elements 14*a*, 14*b*. According to the first line elements 12*a* to 12*c*, the third line elements 26*a* to 26*c* have third meshes 28*a*, 28*a*' that each follow the paths of first meshes 16*a*, 16*a*' and are separated at the regular interval of two meshes 28*a* and 16*a* to form two connecting elements 30, 30' at a time that extend to the top (not shown).

Figure 3:
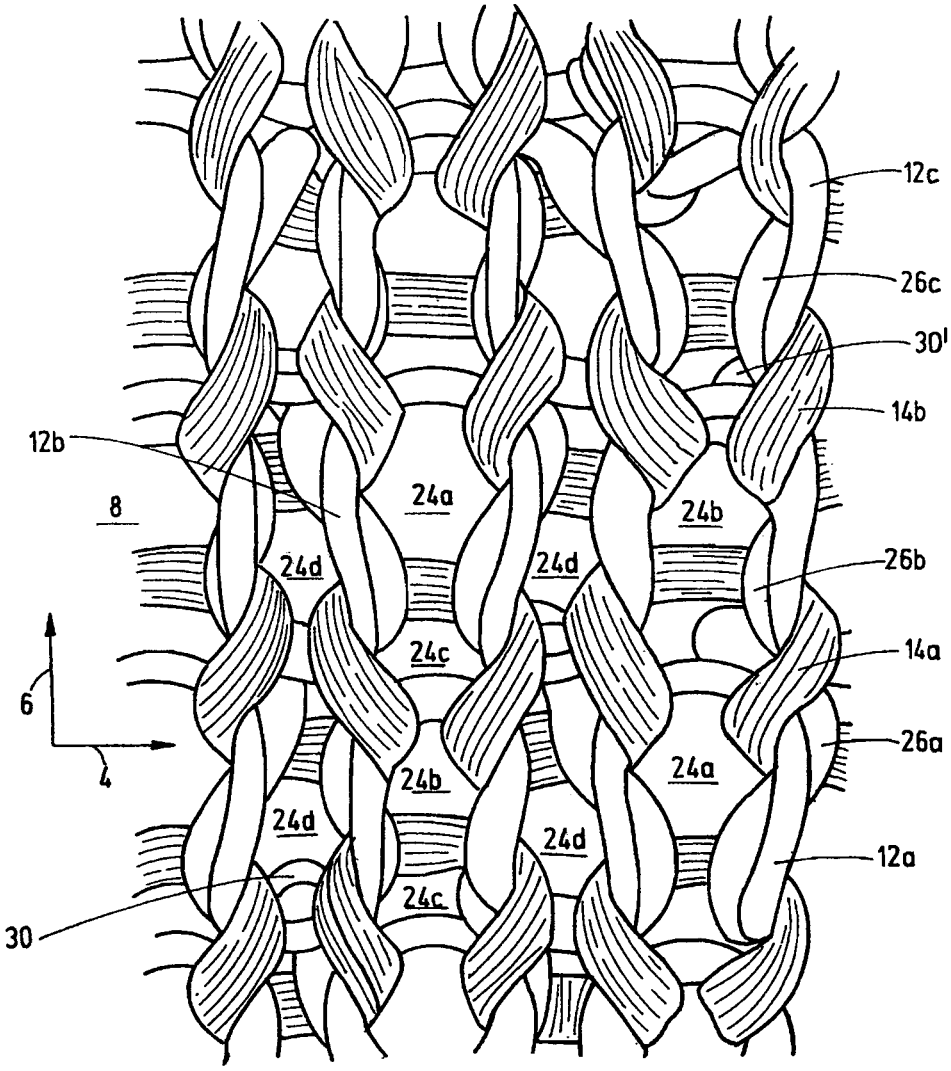
FIG. 3 is an enlarged bottom plan view of the touch-and-close fastener part of FIG. 2.
Figure 4:
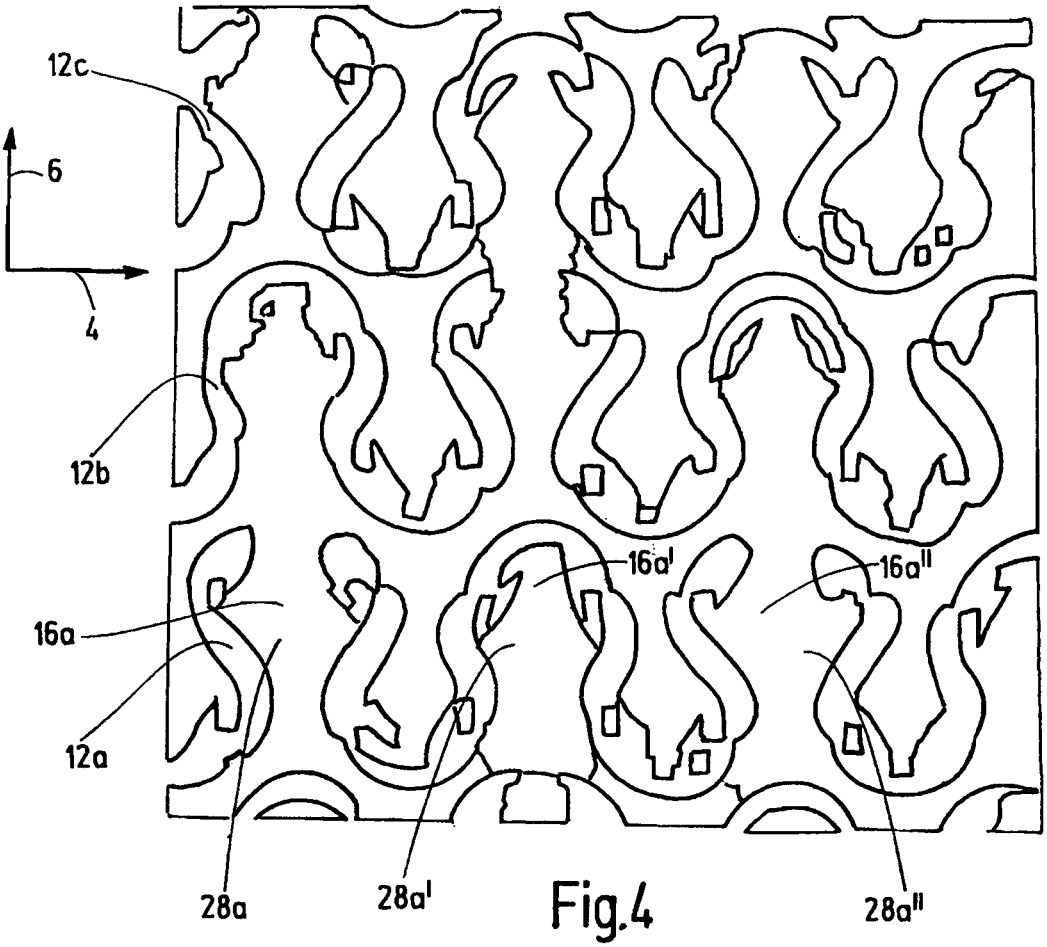
FIG. 4 is a schematic illustration of the arrangement of the two thread systems forming the functional layers according to an exemplary embodiment of the invention.

FIGS. 3 and 4 show the regular arrangement of the line elements 12*a* to 12*d*, 14*a* to 14*d*, 26*a* to 26*c* and the resulting formation of a pattern. The first line elements 12*a*, 12*b*, 12*c* and the second line elements 14*a*, 14*b* form first meshes 16*a*, 16*a*', 16*a*" or second meshes (not labeled) that are arranged regularly both in the longitudinal direction 4 and in the transverse direction 6 in succession and toward one another. The third line elements 26*a* to 26*c* that follow the path of the first line elements 12*a* to 12*c* are separated both in the longitudinal direction 4 and in the transverse direction 6 at every other of the third meshes (not labeled) to form connecting elements 30, 30'.

Figure 5:
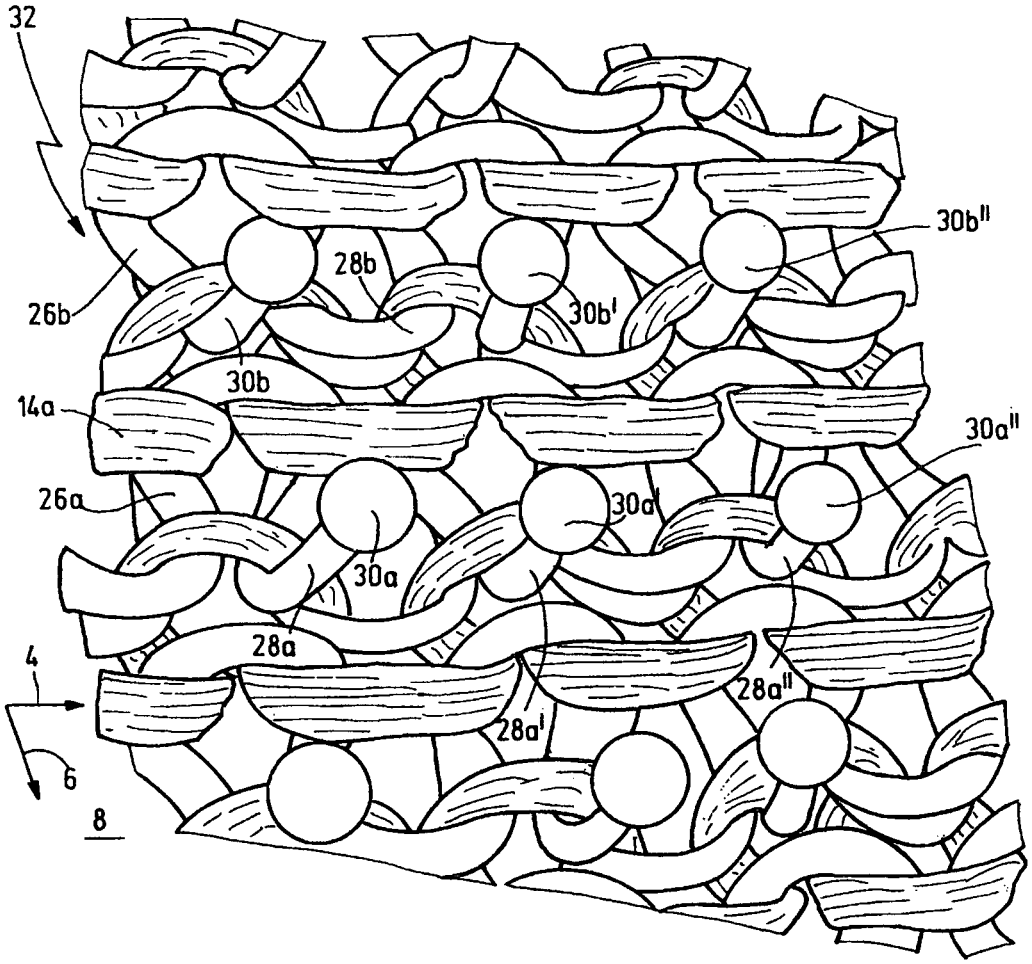
FIG. 5 is a top view of the touch-and-close fastener part of FIGS. 2 and 3.

In the illustrated and described exemplary embodiment, the third line elements 26*a* to 26*c* viewed in the longitudinal and transverse directions 4, 6 are separated at every other third mesh into connecting elements so that at these sites larger passage sites 24*a* compared to passage sites 24*b* are established for third meshes that have not been severed. Further passage sites 24*c* and 24*d* are formed by the arrangement of line elements 12*a* to 12*d*, 14*a* to 14*c*, 26*a* to 26*c* and form a corresponding pattern. A sequence then repeats in the transverse direction 6 according to a sequence of two first line elements 12*a*, 12*b* and two second line elements 14*a*, 14*b*, and a sequence that repeats in the longitudinal direction 4 according to two meshes 16*a*, 16*a*' and 20*a*, 20*a*' and 28*a*, 28*a*'. This pattern unit is repeated along the backing surface 8 in the longitudinal and transverse directions 4, 6 and is visible both on the bottom shown in FIGS. 3 and 4 and on the top is shown in FIG. 5. Consequently, the backing surface 8 has a homogeneous dimensional stability and permeability for fluids, as for a grinding dust exhaust.

FIG. 5 shows a top of a touch-and-close fastener part 32 depicted in the preceding figures. Connecting elements 30*a*, 30*a*', 30*a*" of the third line element 26*a* and connecting elements 30*b*, 30*b*', 30*b*" of the third line element 26*b* project out of the backing surface 8 that is clamped in the longitudinal and transverse directions 4, 6. The third line elements 26*a*, 26*b* are connected to one another according to the first line elements (not labeled) by second line elements 14*a*. The connecting elements 30*a* to 30*b*" each have a mushroom-shaped thickening on the free end and form a hooking hook and loop fastener. The mating component for the touch-and-close fastener part 32 can be, for example, a velour or a fleece. FIG. 5 clearly shows the regularity of the connecting elements 30*a* to 30*b*", where in the longitudinal direction 4 every other third mesh 28*a*, 28*a*" and in the transverse direction 6 likewise every other, i.e., never directly adjacent third meshes 28*a* and 28*b*, are separated and are formed into connecting elements 30*a*, 30*a*'.

Figure 6:
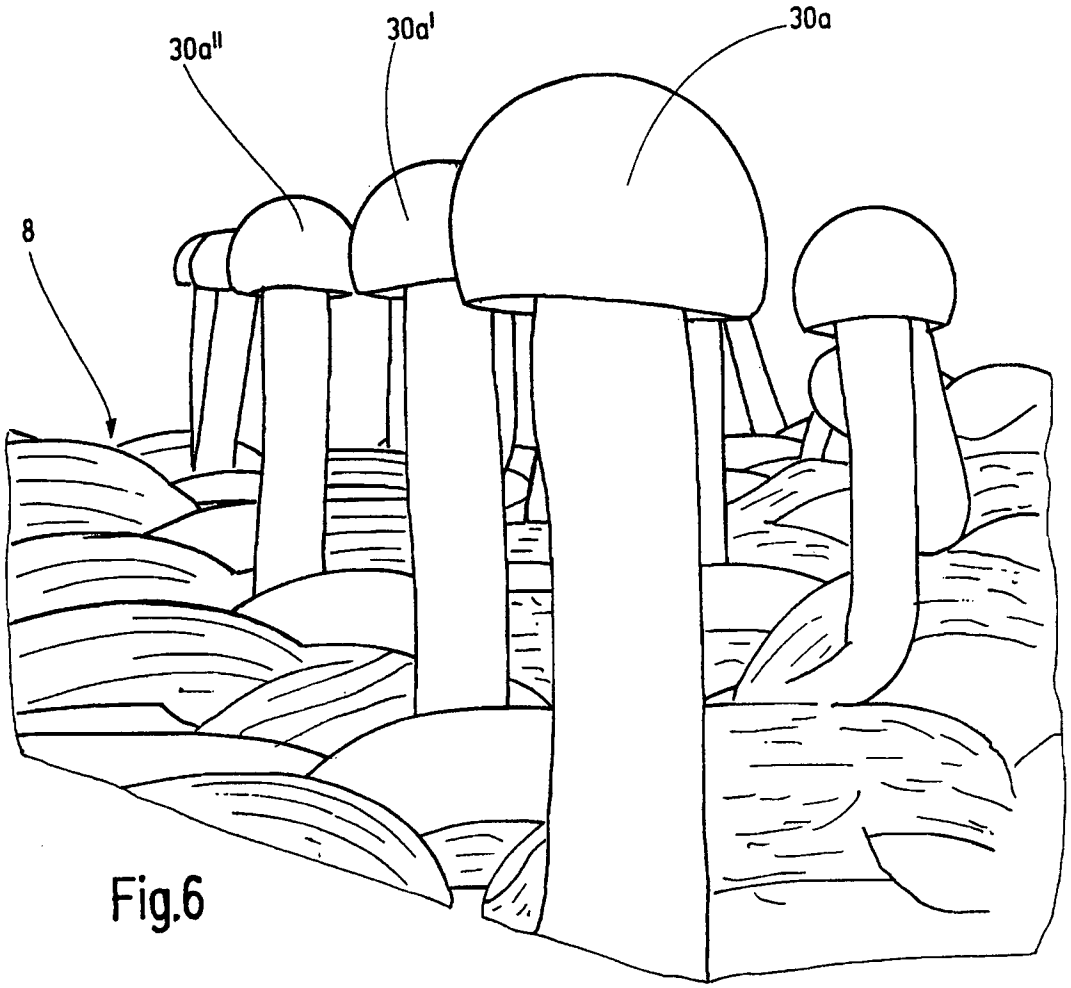
FIG. 6 is a perspective view of an extract of the top of the touch-and-close fastener part of FIG. 5, which extract is enlarged for enhanced representation of connecting elements.

In the illustrated example, for the third line elements 26*a* to 26*c* one monofilament at a time, especially made from isotactic polypropylene, has been used. A material can be chosen that ensures a grinding function for forming the third line elements 26*a* to 26*c* and especially the connecting elements 30*a* to 30*b*". The connecting elements 30*a* to 30*b*", as shown in detail in FIG. 6, can themselves be made as abrasives, but can also have been applied to the backing surface 8 in addition to functional elements that have a grinding function. FIG. 6 clearly shows the mushroom-shaped thickenings on the free ends of the connecting elements 30*a* to 30*a*" and the sequential arrangement of the connecting elements 30*a* to 30*a*" that project essentially vertically out of the backing surface 8.

Figure 7:
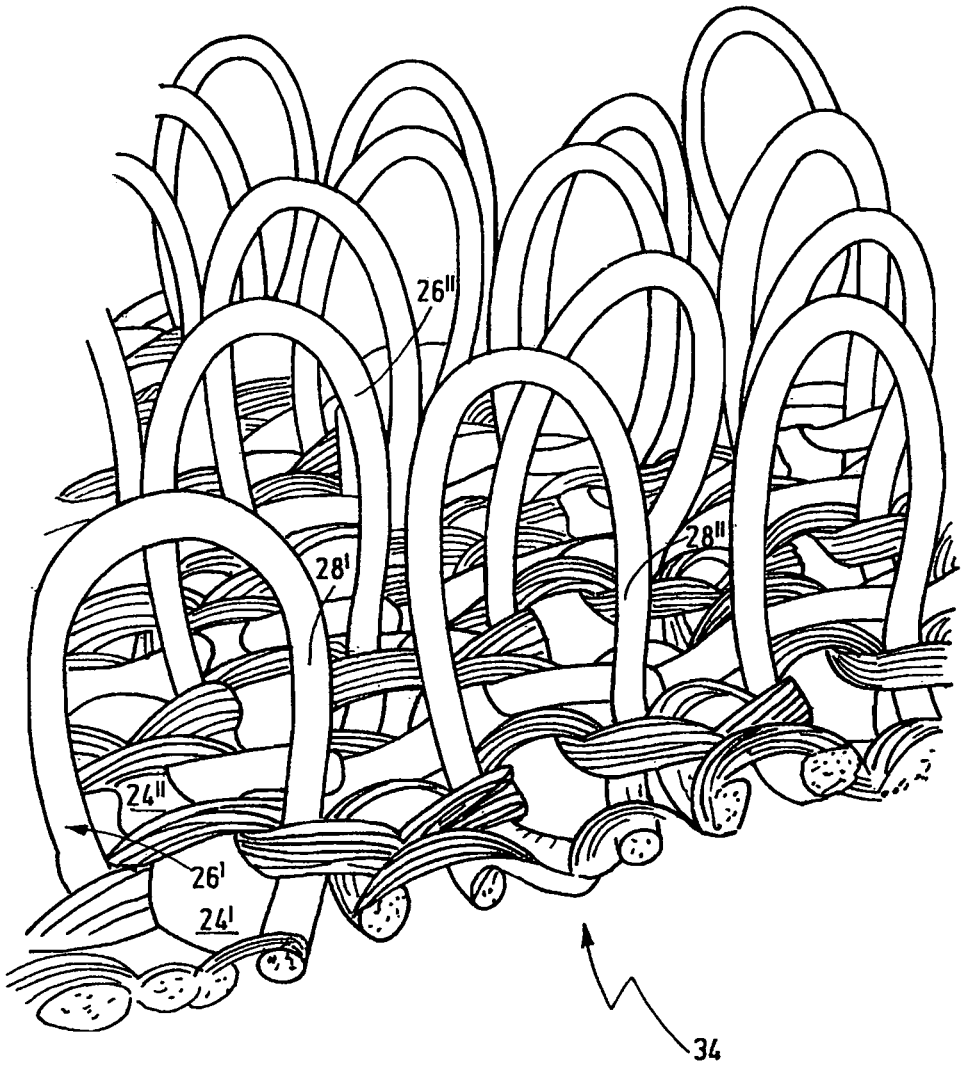
FIG. 7 is a perspective view of a top of a semi-finished article of a touch-and-close fastener part according to a second exemplary embodiment of the invention with two functional layers.
Figure 8:
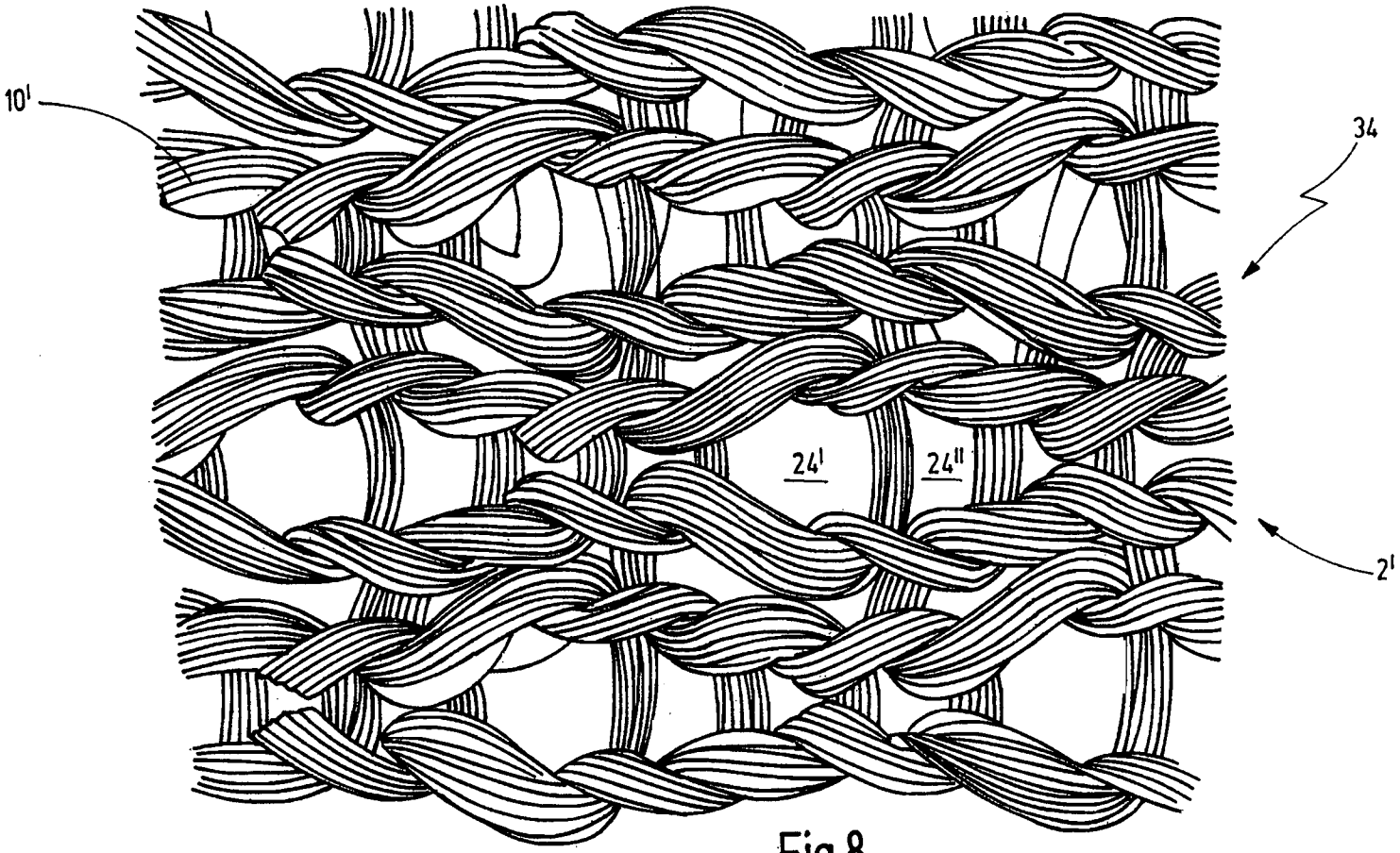
FIG. 8 is a bottom plan view of the semi-finished article of FIG. 7.

FIGS. 7 and 8 show a semi-finished article 34 by which a further touch-and-close fastener part can be made. The intermediate product or semi-finished article 34 is characterized by third line elements 26', 26" or third meshes 28', 28" that project as loops on a top as shown in FIG. 7. The bottom of the semi-finished article 34 shown in FIG. 8 shows that the thread system 10' forming the functional layer 2' is formed completely from multifilaments. The passage sites 24', 24" enable good fluid passage through the functional layer 2' and the semi-finished article 34 or a touch-and-close fastener part formed from it.

The above-described, highly air-permeable touch-and-close fastener part 32 can also be used especially in the automotive sector, preferably in the region of the seat part upholstery of motor vehicles. In particular, the touch-and-close fastener part 32 is suited for covering the upholstery materials of the vehicle seat to the outside, but retaining the possibility of airflow through the meshes of the touch-and-close fastener part that are open in this respect. In addition to increasing seating comfort, this structure permits it to effectively climatize the seat accordingly, i.e., to optimally implement hot or cooling airflow. In addition to the fact that the touch-and-close fastener part can, as a result of its closure elements, be easily detached from the other upholstery covering or upholstery materials, a possibility exists of replacing it with a correspondingly designed new touch-and-close fastener part.

While various embodiments have been chosen to illustrate the invention, it will be understood by those skilled in the art that various changes and modifications can be made therein without departing from the scope of the invention as defined in the appended claims.

What is claimed is:

1. A touch-and-close fastener part, comprising:

a first functional layer forming a backing surface formed from a first thread system having at least first and second line elements forming meshes and being connected to one another, said first thread system including a series arrangement of said first and second line elements that are adjacent to one another and that extend in a longitudinal direction, each of said first and second line elements forming a sequence of essentially identical meshes facing in a transverse direction without offsets relative to one another in the longitudinal direction, said meshes of at least one said first and second line elements extending at least one of through or around said meshes of an adjacent one of said first and second line elements, said meshes of adjacent ones of said first and second line elements having essentially same extensions in the longitudinal direction and in the transverse direction, said first thread system forming a pattern repeating at regular intervals in the longitudinal and transverse directions and being composed of identically arranged line elements; and a second individual functional layer having connecting elements formed from a second thread system incorporated at least in individual sections of said first thread system, said first and second thread systems being connected to one another and having passage openings therethrough, said passage openings having free-cross-sectional areas making up more than twenty percent of an area of said backing surface.

2. A touch-and-close fastener part according to claim 1 wherein said second thread system comprises at least one third line element extending in the longitudinal direction with a sequence of essentially identical meshes facing in the transverse direction, said at least one third line element being at least partially separated to form said connecting elements.

3. A touch-and-close fastener part according to claim 2 wherein said at least one third line element follows a path of a corresponding one of said first line elements and is incorporated therewith via respective ones of said meshes.

4. A touch-and-close fastener part according to claim 1 wherein said series arrangement alternates said first and second line elements, said meshes of said first line elements have a greater extension in the transverse direction greater than meshes of said second line elements.

5. A touch-and-close fastener part according to claim 1 wherein said passage openings have parallelogram shapes.

6. A touch-and-close fastener part according to claim 5 wherein said parallelogram shapes are one of diamond shapes, rectangular shapes, polygonal shapes and hexagonal shapes.

7. A touch-and-close fastener part according to claim 1 wherein said functional layers are produced from isotactic polypropylene.

8. A touch-and-close fastener part according to claim 1 wherein said line elements comprise at least one of monofilaments, multifilaments or yarns.

9. A touch-and-close fastener part according to claim 2 wherein said connecting elements have at least one of interlocking heads or mushroom-shaped heads.

10. A touch-and-close fastener part according to claim 2 wherein said connecting elements are arranged on one side of said second individual functional layer.

11. A touch-and-close fastener part according to claim 1 wherein said first and second functional layers form an abrasive.

12. A method for producing a touch-and-close fastener part, comprising the steps of:

forming a first functional layer forming a backing surface formed from a first thread system having at least first and second line elements forming meshes and being connected to one another, said thread system including a series arrangement of said first and second line elements that are adjacent to one another and extend in a longitudinal direction, each of said line elements forming a sequence of essentially identical meshes facing in a transverse direction without offsets relative to one another in the longitudinal direction, said meshes of at least one of said first and second line elements extending at least one of through or around said meshes of an adjacent one of said first and second line elements, said meshes of adjacent ones of said first and second line elements having essentially same extensions in the longitudinal direction and in the transverse direction, said first thread system forming a pattern repeating at regular intervals in the longitudinal and transverse directions and being composed of identically arranged line elements; and forming a second individual functional layer having connecting elements formed from a second thread system incorporated at least in individual sections of said first thread system, said first and second thread systems being connected to one another with passage openings therethrough, said passage openings having free-cross-sectional areas making up more than twenty percent of an area of said backing surface.

13. A method according to claim 12 wherein at least one line element of said second thread system is separated and formed into connecting elements.

14. A method according to claim 13 wherein respective ones of said meshes are clipped to form separated meshes; and free ends of said separated meshes are melted to form mushroom head-shaped thickenings.

15. A method according to claim 14 wherein the free ends are melted by singeing.

* * * * *